US010233630B1

(12) United States Patent
Francies, III

(10) Patent No.: US 10,233,630 B1
(45) Date of Patent: Mar. 19, 2019

(54) BRACKET ASSEMBLY HAVING A ROTATING LOCKING PLATE

(71) Applicant: MAESTRO INTERNATIONAL, LLC, Lithia, FL (US)

(72) Inventor: Sidney E. Francies, III, Lithia, FL (US)

(73) Assignee: MAESTRO INTERNATIONAL, LLC, Lithia, FL (US)

( * ) Notice: Subject to any disclaimer, the term of this patent is extended or adjusted under 35 U.S.C. 154(b) by 0 days.

(21) Appl. No.: 15/823,040

(22) Filed: Nov. 27, 2017

(51) Int. Cl.

| | |
|---|---|
| ***E04B 1/04*** | (2006.01) |
| ***E04B 1/26*** | (2006.01) |
| ***E04B 1/24*** | (2006.01) |
| ***E04B 1/21*** | (2006.01) |
| *E04B 1/38* | (2006.01) |

(52) U.S. Cl.
CPC ..... *E04B 1/043* (2013.01); *E04B 1/215* (2013.01); *E04B 1/2403* (2013.01); *E04B 1/2608* (2013.01); *E04B 2001/2439* (2013.01); *E04B 2001/2644* (2013.01); *E04B 2001/2684* (2013.01); *E04B 2001/405* (2013.01)

(58) Field of Classification Search
CPC ..... E04B 1/4114; E04B 1/6183; E04B 1/043; E04B 1/215; E04B 1/2403; E04B 1/2608; E04B 2001/2406; E04B 2001/2409; E04B 2001/2415; E04B 2001/2421; E04B 2001/2463; F16B 21/02; F16B 5/0004; F16B 5/0008; F16B 5/008; F16B 5/0084; F16B 5/0092; Y10T 403/7005; Y10T 403/7009
See application file for complete search history.

(56) References Cited

U.S. PATENT DOCUMENTS

| | | | | |
|---|---|---|---|---|
| 1,929,835 A * | 10/1933 | Awbrey | E04B 1/4107 | 52/379 |
| 3,995,923 A * | 12/1976 | Shell | F16B 5/0092 | 312/111 |
| 5,155,960 A * | 10/1992 | Shaanan | F16B 5/0092 | 24/580.11 |
| 5,548,939 A * | 8/1996 | Carmical | E04B 1/4135 | 52/698 |
| 6,237,970 B1 * | 5/2001 | Joannou | E05B 65/006 | 292/241 |
| 6,494,639 B1 * | 12/2002 | Friend | E04B 1/043 | 403/205 |

(Continued)

OTHER PUBLICATIONS

Sidney E. Francies, III, Rotating Pin Locking Connector, U.S. Appl. No. 15/452,755, filed Mar. 8, 2017, Specification 13 pages, and Figures 23 pages.

*Primary Examiner* — Jonathan P Masinick
(74) *Attorney, Agent, or Firm* — McGarry Bair PC

(57) ABSTRACT

A connector includes a embed plate having a hollow rectangular tube to be cast with a structure. An support member has a post extending with a pin extending radially through the post at a distal end. The pin is shorter than the longer rectangular dimension and longer than the shorter rectangular dimension. When the support member is positioned adjacent the embed plate and oriented with a longitudinal axis of the pin parallel to the longer rectangular dimension, the post can be inserted into the hollow tube and rotated to a position where the pin abuts a distal end of the hollow tube to lock the support member to the embed plate.

19 Claims, 7 Drawing Sheets

(56) References Cited

U.S. PATENT DOCUMENTS

| | | | | |
|---|---|---|---|---|
| 7,814,710 | B2 * | 10/2010 | Foglia | E04B 1/4107 52/709 |
| 8,209,924 | B2 * | 7/2012 | Foley | E04B 1/2403 403/403 |
| 8,209,925 | B2 * | 7/2012 | Foley | E04B 1/2403 403/403 |
| 8,365,484 | B2 * | 2/2013 | Foley | E04B 1/4114 403/403 |
| 8,534,154 | B2 * | 9/2013 | Li | B25J 9/1697 403/348 |
| 8,635,832 | B2 * | 1/2014 | Heudorfer | E04B 1/4107 52/704 |
| 2011/0262243 | A1 * | 10/2011 | Glickman | F16B 21/02 411/337 |

* cited by examiner

BRACKET ASSEMBLY HAVING A ROTATING LOCKING PLATE

BACKGROUND OF THE INVENTION

Precast structures are commonly used in construction. For example, one of the most common materials for precasting is concrete, and precast concrete panels are typically used for floors, walls, ceilings, facings, and other features of building construction. It is also common to connect such precast structures to other precast structures, and to connect other elements to a precast structure.

Known means of such connections include affixing brackets to a concrete panel by adhesives or bolts, adapting hook and eye connectors, and embedding plates into a concrete panel at the time of casting.

SUMMARY OF THE INVENTION

One embodiment of the present disclosure is a bracket assembly for mounting in a cast structure. The bracket assembly comprises an embed plate having an aperture with first cross sections of at least a longer and a shorter dimension and one or more anchors extending from the embed plate and a support member having a rear surface configured to be connected to the embed plate. The support member comprises a locking plate with a shape complementary to the aperture shape with second cross sections of at least a longer and a shorter dimension and sized to fit in the aperture. The support member also comprises a shaft having a proximal end connected to the rear surface of the support member and a distal end, spaced from the proximal end connected to the locking plate. When the locking plate is positioned adjacent the embed plate, the locking plate can be inserted into the aperture of the embed plate and rotated to a position where a longer cross section of the locking plate overlaps the shorter cross section of the aperture so the longer cross section of the locking plate abuts the embed plate.

Another aspect of the present disclosure is a method of connecting a support member to a cast structure. The method comprises casting an embed plate in a cast structure. The embed plate has an aperture with first cross sections of at least a longer and a shorter dimension, and one or more anchors extending from the embed plate. The method also comprises forming a recess in back of the aperture. A support member is provided that has a back surface configured to be connected to the embed plate, a shaft that extends from a back surface of the support member, and a locking plate extending from a distal end of the shaft. The locking plate has a shape complementary to the aperture shape with second cross sections of at least a longer and a shorter dimension and sized to fit in the aperture. The method further comprises aligning the orientations of the locking plate and the aperture; inserting the locking plate into the aperture until the locking plate is in the recess; and, rotating the support member relative to the embed plate until the locking plate abuts the rear surface of the embed plate.

DETAILED DESCRIPTION

Figure 1:
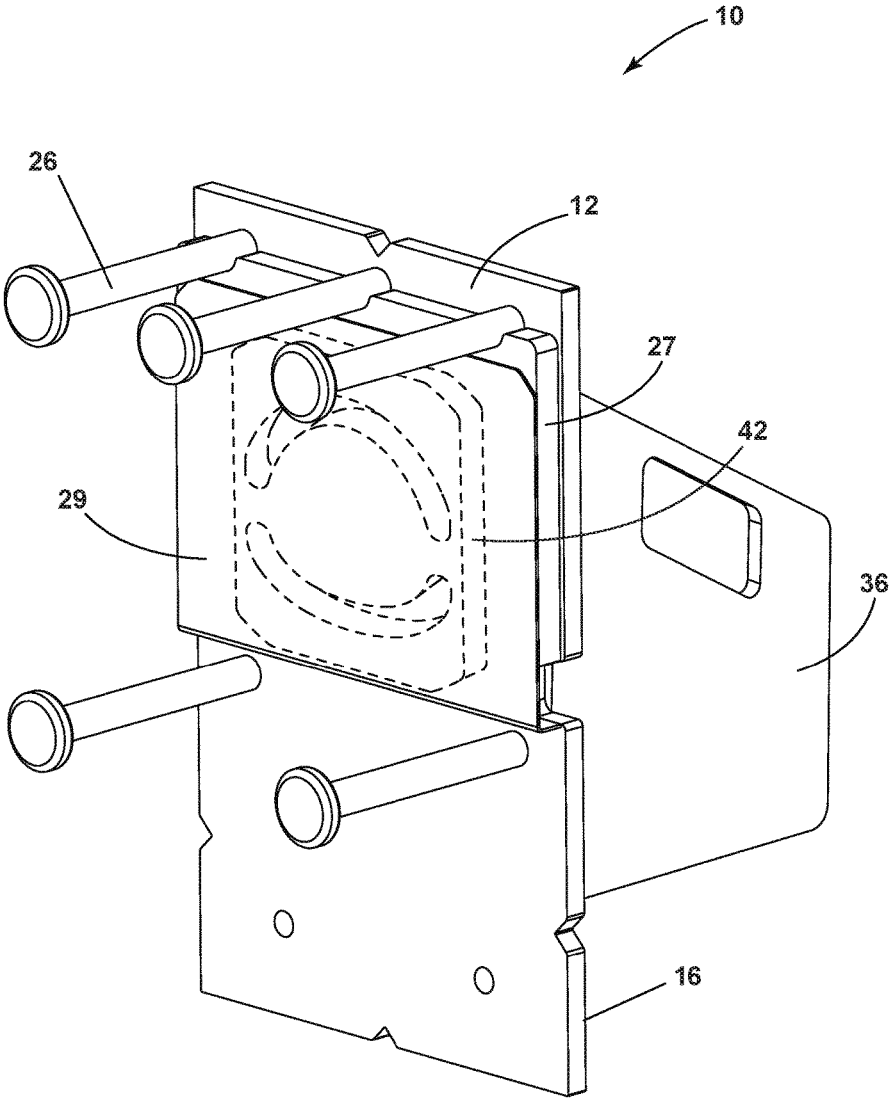
FIG. 1 is top perspective view of a bracket assembly in accordance with the present disclosure.
Figure 2:
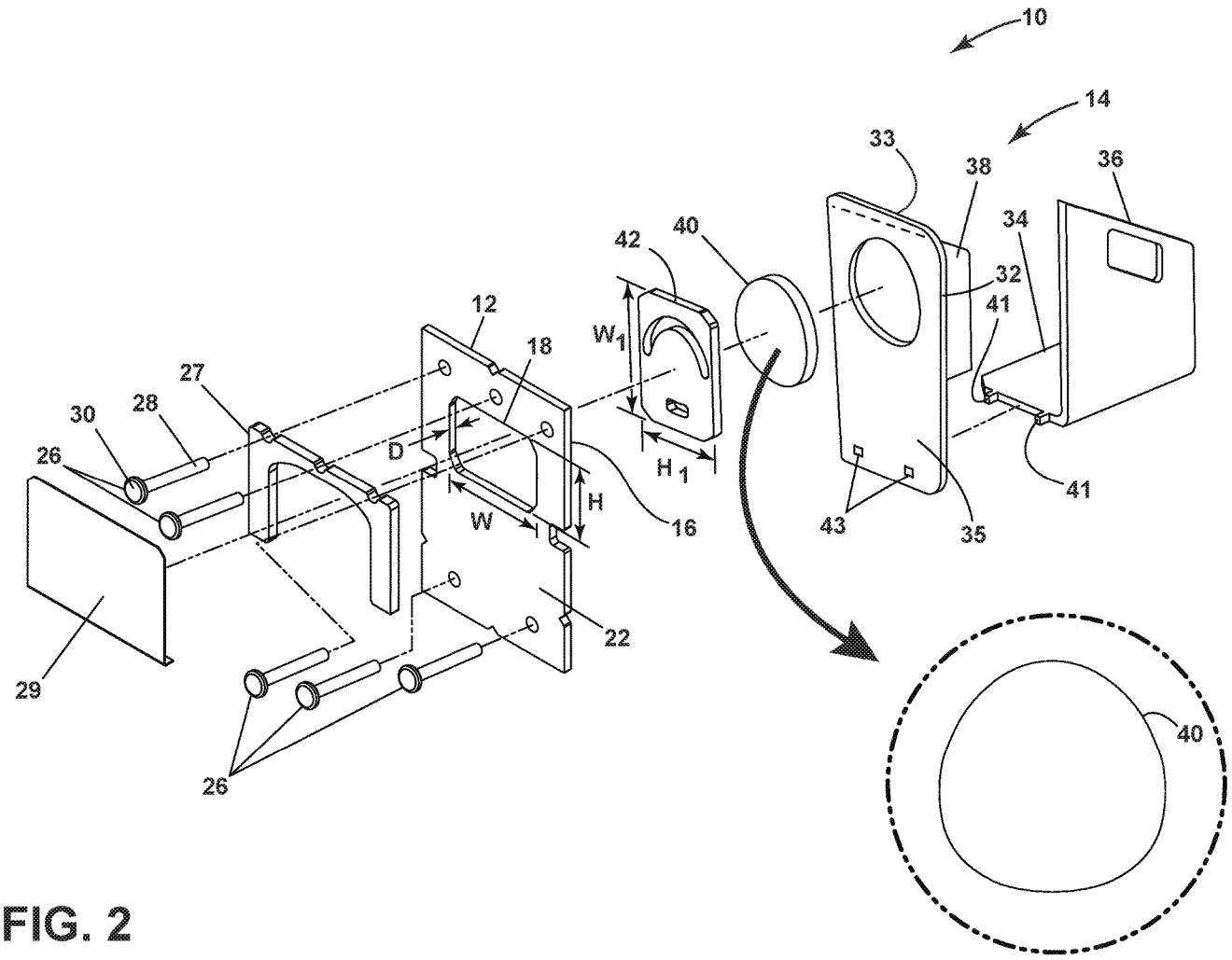
FIG. 2 is an exploded view of the parts of the bracket assembly shown in FIG. 1.

FIGS. 1 and 2 are a top perspective and an exploded view of a bracket or corbel assembly 10 according to an embodiment of the disclosure. The bracket assembly 10 can include an embed plate 12 having a front surface 16, an aperture 18, and a rear surface 22. The aperture 18 can be generally a rectangular shape, although it should be recognized that other shapes are within the scope of the invention. It will be understood that any shape for the aperture 18 is feasible so long as the shape has two or more various dimensions. For example, in the rectangular shape, the aperture 18 can have a wider width (W) than height (H).

A set of anchors 26 extends from the rear surface 22 of the embed plate 12 and are intended to be long enough to allow the embed plate 12 to be cast in concrete. Each anchor 26 may have a shaft 28 and a foot 30 to facilitate embedment. The number of anchors may vary depending in application; in the example shown in FIG. 1 there are five. The anchors 26 can be welded to the rear surface 22 of the embed plate 12 or otherwise securely attached.

A recess plate 27 can be securely attached to the rear surface 22 of the embed plate 12. The recess plate 27 could be integrally formed with the embed plate 12, or could be glued, welded or otherwise bonded or attached to the embed plate 12. The recess plate 27 can be generally "U" shaped and configured to at least partially surround the aperture 18. It is contemplated the recess plate 27 can be made from plastic, although it could be made from metal such as steel.

A cover plate 29 can be provided to cover the recess plate 27. The cover plate 29 can also be securely attached or integrally formed with the recess plate 27 and the embed plate 12. The cover plate 29 is also contemplated to be made from plastic, although it could also be made from metal such as steel. The recess plate 27 and the cover plate 29 combine to form a recess or cavity in back of the aperture 18 when the embed plate 12 is embedded in precast concrete. It should be recognized that to form a cavity, the recess plate 27 has a thickness that can be varied as needed to create a cavity of various sizes or depths.

The support member 14 in the structure of a "saddle" can be provided to securely attach to the embed plate 12 after embed plate 12 has been cast in concrete. Support member 14 comprises a face plate 32, having a front surface 33, a back surface 35, a base plate 34, and side walls 36, 38. As illustrated, the support member 14 can comprises two portions. A first portion comprised of the base plate 34 having alignment tabs 41 integrally formed with side wall 36 by forging, forming, or stamping. And, a second portion, comprised of the face plate 32 integrally formed with side wall 38 and having one or more alignment apertures 43 to align with alignment tabs 40 on the base plate 34. The two portions can be welded or otherwise securely attached together. As should be recognized the base plate 34 need not extend normally from the plate 32 but can in some instances be formed at an angle depending on the application.

A shaft 40 can extend from the back surface 35 of the face plate 32, or through the face plate 32 and can be secured such as by welding or some other secure fastening means. The shaft 40 is long enough to extend from the back surface 35 of the face plate 32 a distance greater than depth (D) of the aperture 18. While the shaft 40 can be any generally circular shape, it is contemplated that the shaft 40 is egg or ellipse shaped with the narrow portion of the ellipse toward the top of shaft 40 and the wider portion of eclipse toward the bottom of the shaft 40 as illustrated in FIG. 2.

A locking plate 42 can be secured to a distal end of the shaft 40. The locking plate 42 is contemplated to be a shape complementary to aperture 18, so as to fit through the aperture 18. As illustrated, the locking plate 42 is generally rectangular with cross-sections of various dimensions, $W_1$ and $H_1$. As should be recognized the locking plate 42 can be sized to fit within or through aperture 18.

Figure 3:
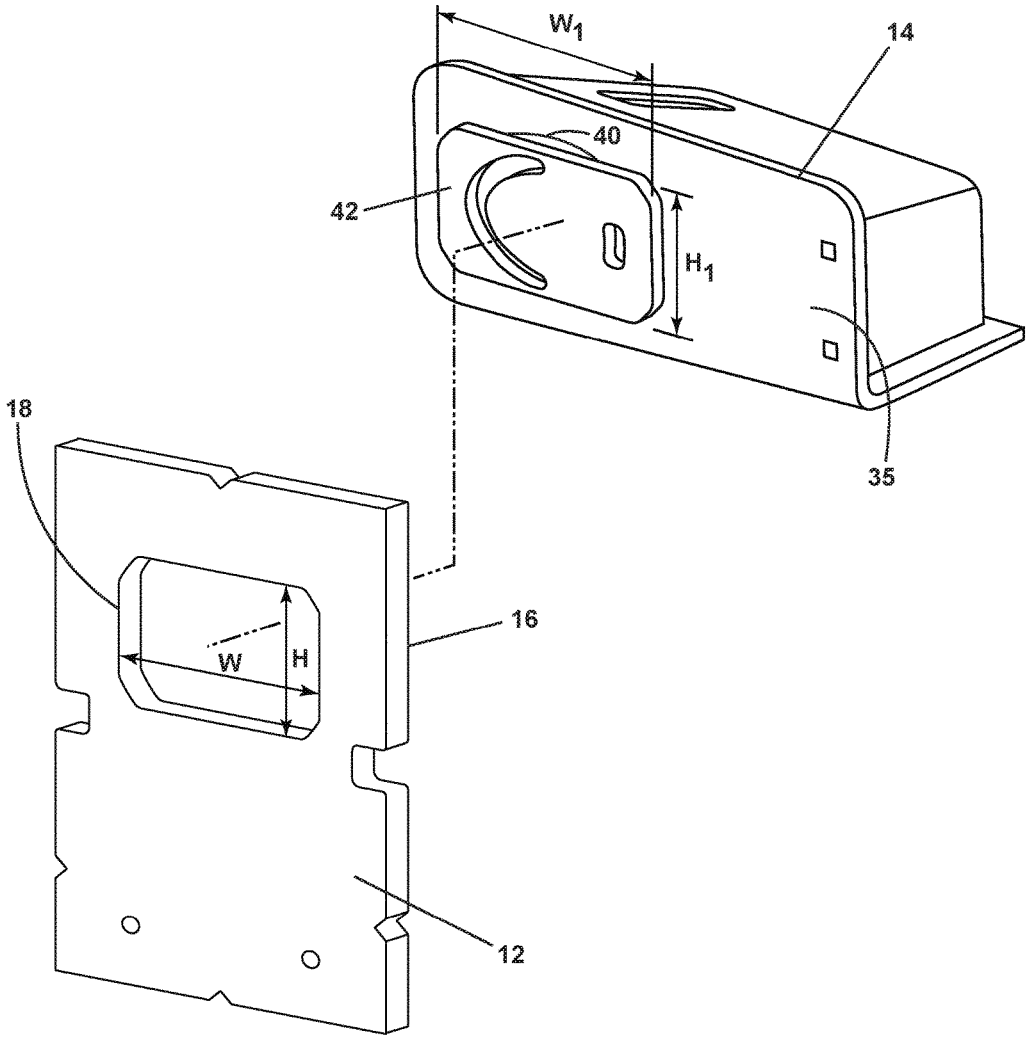
FIG. 3 is a perspective view of an embed plate and support member of the bracket assembly of FIG. 1 before assembly.
Figure 4:
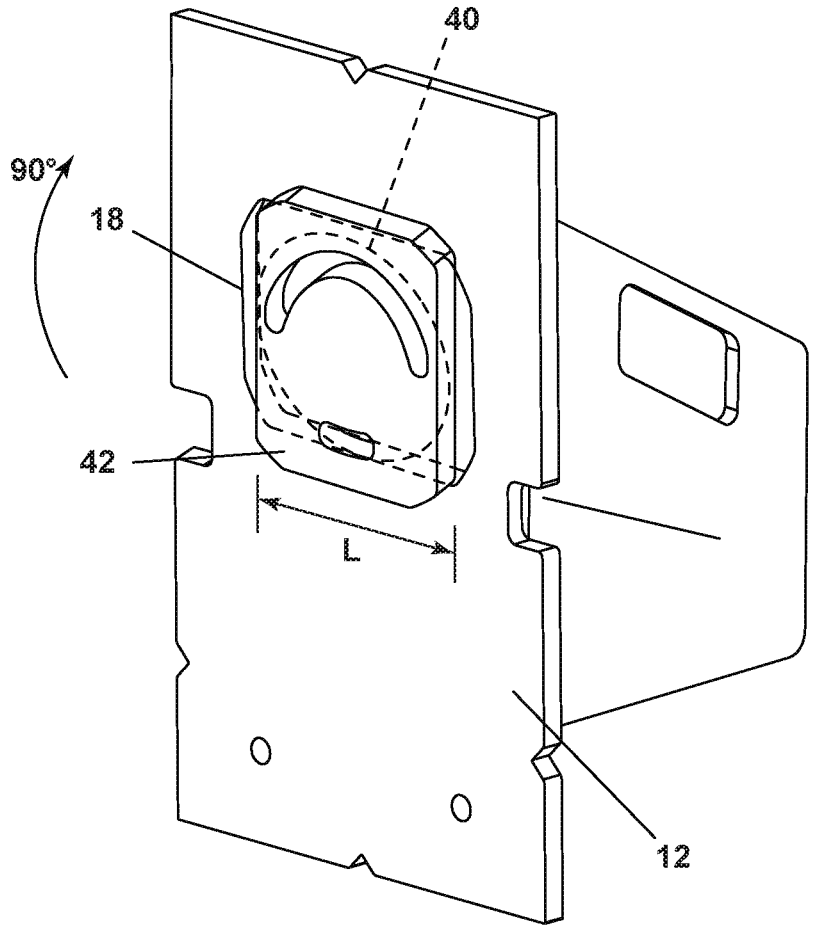
FIG. 4 is a perspective view of an embed plate and support member of the bracket assembly of FIG. 1 after assembly.

Looking at FIGS. 3 and 4, one can see that when the support member 14 is oriented so that the width $W_1$ of the locking plate 42 is parallel to the width W of the aperture 18, the locking plate 42 can be received in the aperture 18 until the rear surface 35 of the plate 32 of the support member 14 abuts or is substantially flush with the front surface 16 of the embed plate 12. As a result, the shaft 40 will extend through the aperture 18 so that the locking plate 42 is in the recess created by recess plate 27.

Once the locking plate 42 is inserted in the aperture 18, the support member 14 and thus the locking plate 42 can be rotated relative to the embed plate 12. Rotating the support member 90 degrees causes the locking plate 42 to rotate 90 degrees so that the width $W_1$ on the locking plate 42 overlaps the shorter height H of the aperture 18 such that the locking plate 42 abuts the rear surface 22 of embed plate 12. Although not shown, either the locking plate 42 or the rear surface 22 of the embed plate 12 can be dimensioned to have an interference fit with the other to aid in locking the support member 14 relative to the embed plate 12.

Further it should be understood that the support member 14 can be retained in a partly rotated position if desired. The egg shape cross-section of the shaft 40 allows the support member 14 to rotate and its shape helps maintain or lock support member 14 at an angle to the embed plate 12. This allows the support member 14 to be maintained at an angle of up to 15 degrees from a vertical position.

It should also be recognized that once the support member 14 is rotated 90 degrees and is positioned within the embed plate 12, the support member 14 can be positioned laterally L relative to the embed plate 12. The width of the shaft 40 is less than the width W of the aperture 18. Thus, the shaft 40 can be laterally adjusted within the aperture 18 to allow the support member 14 to laterally move relative to the embed plate 12. In an exemplary embodiment, the support member 14 can be designed to allow at least 1 inch of lateral movement relative to the embed plate 12.

Figure 5:
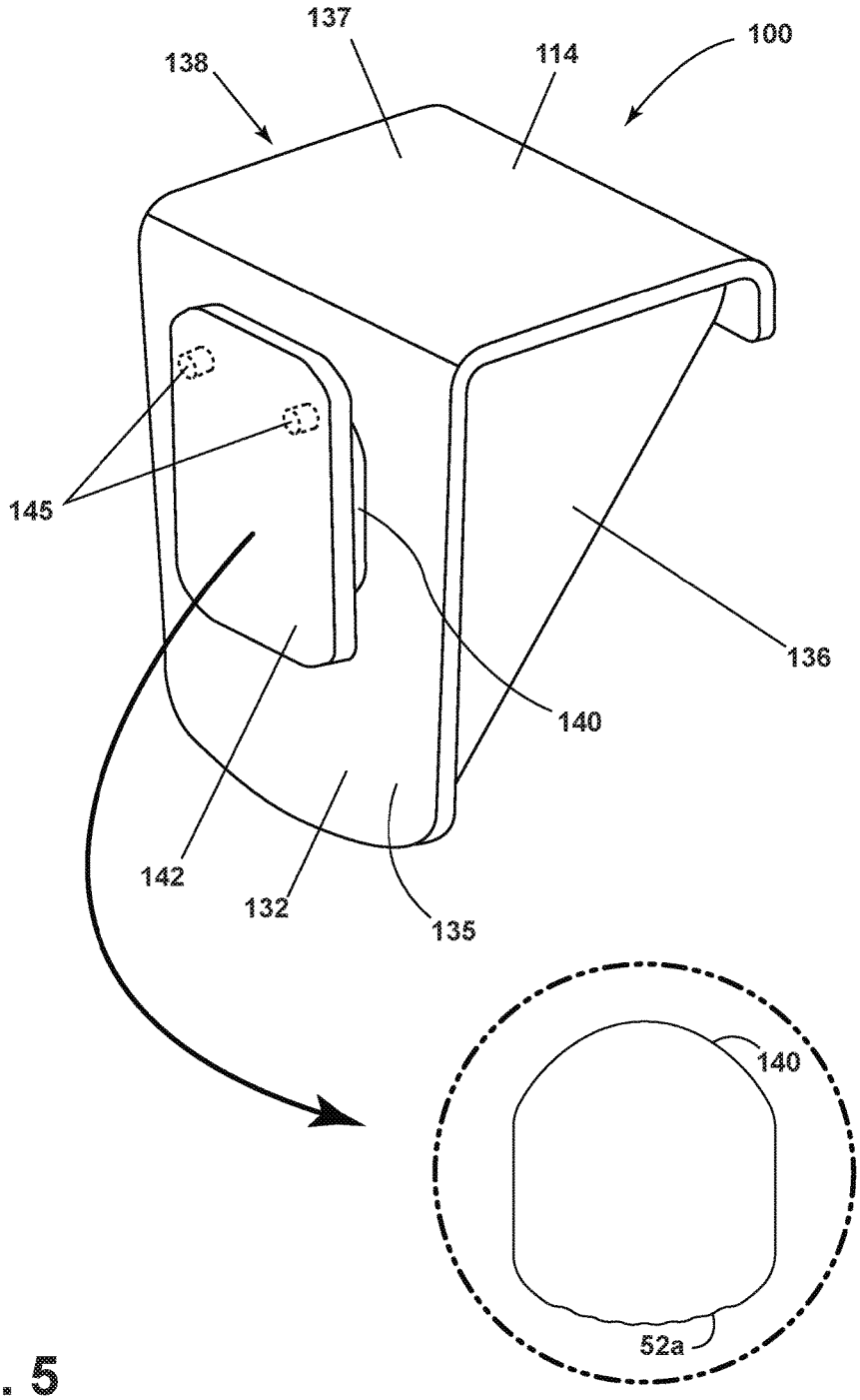
FIG. 5 is a perspective view of a support member of the present disclosure before assembly to an embed plate of a bracket assembly.
Figure 6:
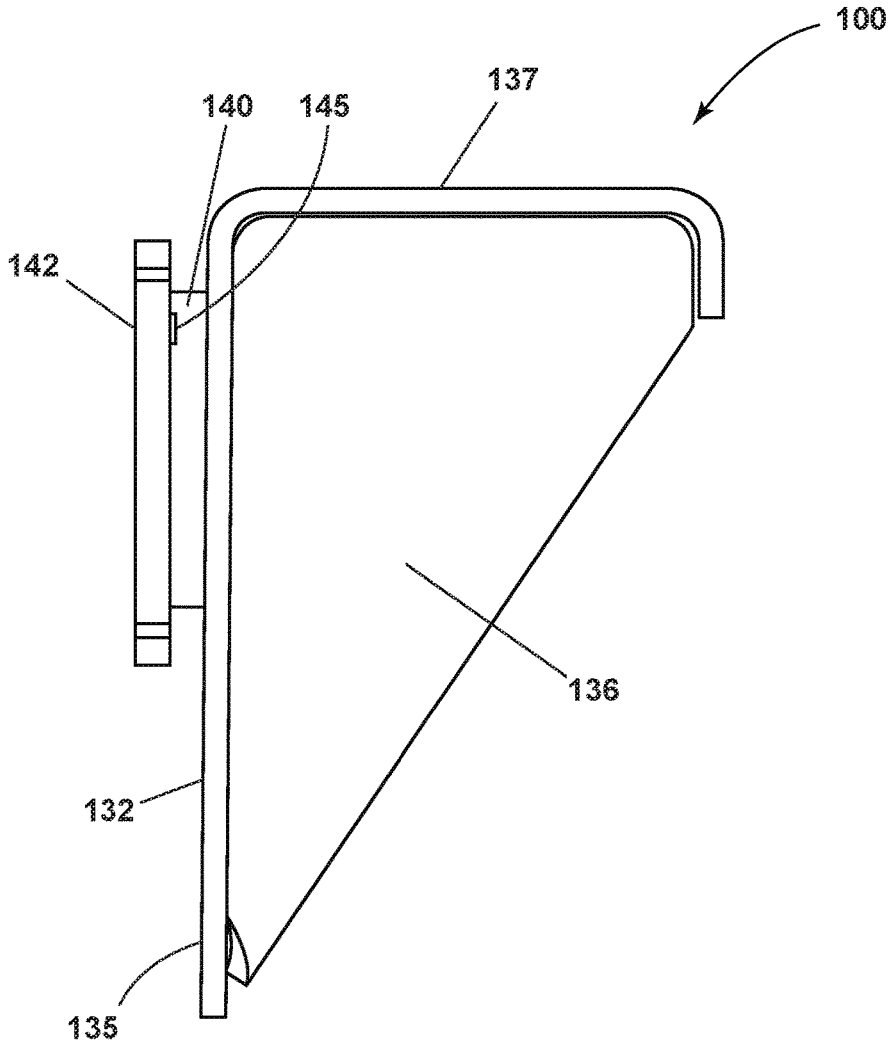
FIG. 6 is a side view of a support member of the present disclosure after assembly to an embed plate of a bracket assembly.
Figure 7:
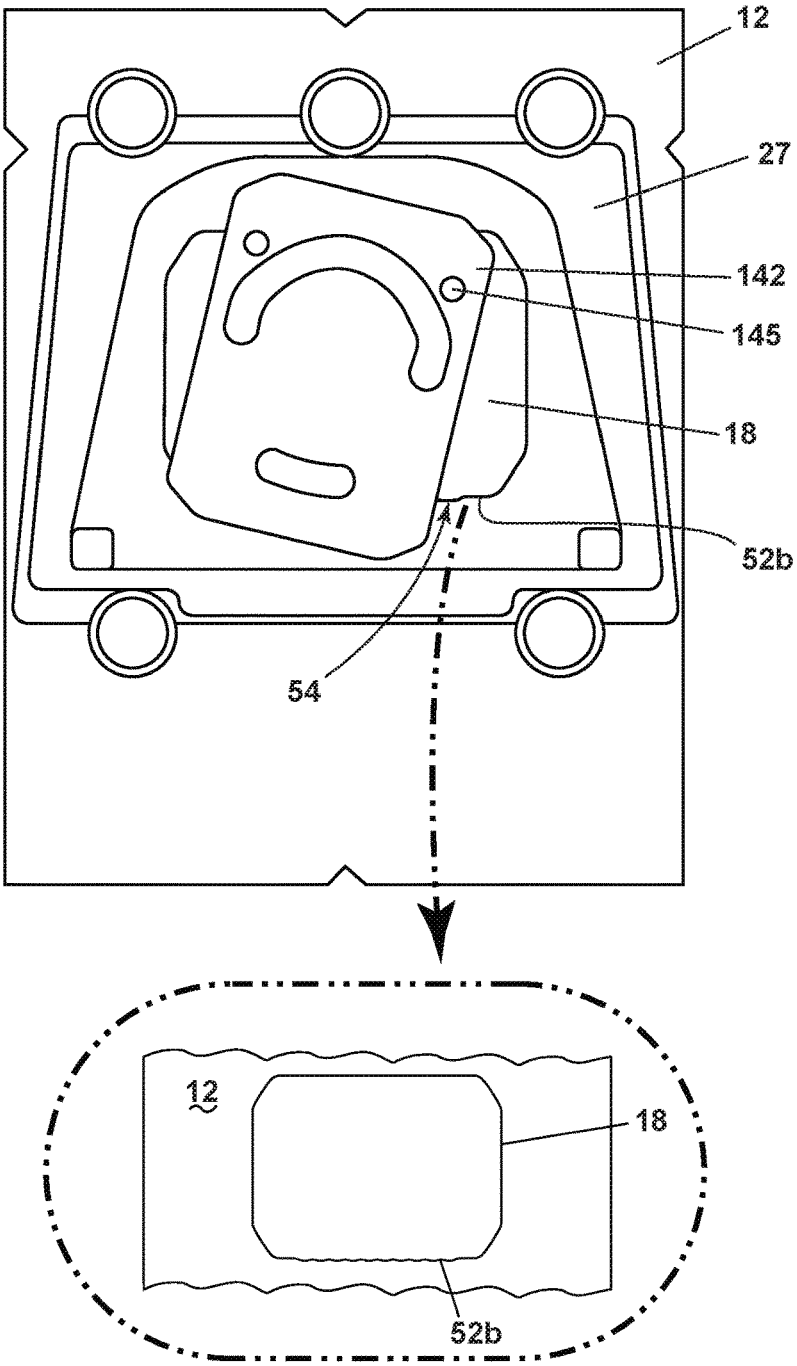
FIG. 7 is a rear view of a support member of the present disclosure after assembly to an embed plate of a bracket assembly and rotated between 0-15 degrees from vertical.

FIGS. 5-7 illustrate another embodiment of a bracket or corbel assembly 100 according to the invention. The bracket assembly 100 is similar in function to the bracket or corbel assembly 10 as previously described, thus, like parts will be identified with like numerals increased by 100.

In this embodiment the support member 114 can take the form of a "gusset". Here, the support member 114 can comprise a face plate 132, having a back surface 135, a top plate 137, and side walls 136, 138. The face plate 132, top plate 137 and side walls 136, 138 can be welded or otherwise securely attached together. As should be recognized the top plate 137 need not extend normally from the face plate 132 but can in some instances be formed at an angle depending on the application. The side walls 136 provide support for supporting a load on top plate 137.

A shaft 140 can extend from the back surface 135 of the face plate 132, or through the face plate 132, and can be secured such as by welding or some other secure fastening means. The shaft 140 is once again long enough to extend from the back surface 135 a distance greater than depth D of aperture 18 on embed plate 12. While the shaft 140 can be any generally circular shape, it is contemplated that the shaft 40 is egg or eclipse shaped with the narrow portion of the eclipse toward the top of shaft and the wider portion of eclipse toward the bottom of the shaft. In addition, in this embodiment, the shaft 140 can be provided with one or more wave grooves 52*a* located along the bottom surface of the shaft 140. The wave grooves 52*a* are contemplated to be a series of indentation along the bottom surface.

A locking plate 142 can be secured to a distal end of the shaft 140. The locking plate 142 is contemplated to be a shape complementary to aperture 18, so as to fit through the aperture 18. As illustrated, the locking plate 142 is generally rectangular and sized to fit within aperture 18. The locking plate 142 can further comprise locking pins 145 positioned on the each side of the locking plate 142 and extending toward the back surface 135 of the face plate 132. The locking pins 145 can be positioned adjacent to the upper outer surfaces of the shaft 140. The locking pins 145 can be of sufficient length to allow the locking plate 142 to rotate 90 degrees upon insertion into aperture 18 of embed plate 12, and after 90 degree rotation, the locking plate 142 can be slightly pushed in so the locking pins are within aperture 18. Once locking pins 145 are positioned in aperture 18, the locking pins 145 prevent the gusset from over-rotating.

As shown in FIG. 7, the locking pins 145 can help prevent the support member 114 from over rotating once the support member 114 is connected to the embed plate 12 and supporting a load on top plate 137. As the shaft 140 and locking plate 142 rotate, so do the spaced apart locking pins 145. If rotated clockwise, as shown in FIG. 7, the left locking pin 145 rotates up toward a top surface of the aperture 18 and the right locking pin 145 rotates toward a side wall of the aperture 18. Conversely, if rotated counter-clockwise, the right locking pin 145 rotates up toward a top surface of the aperture 18 and the left locking pin 145 rotates toward a side wall of the aperture 18. In either case, contact with the upper surface or the sidewalls of the aperture 18 helps prevent over rotation of shaft 140.

In addition, the aperture 18 in the embed plate 12 can be provided with one or more wave grooves 52*b* configured to be engaged by the wave grooves 52*a* on the shaft 140. The wave grooves 52*b* can be a series of indentations provided along at least a portion of the bottom surface 54 of the aperture 18. The wave grooves 52*b* can also be complementary in shape to the wave grooves 52*a* on shaft 140. The wave grooves 52*a*, 52*b* are configured interconnect to help maintain the support member 114 in position, including a rotated position, during initial setting and while under load.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A bracket assembly for mounting in a cast structure, comprising:

an embed plate having an aperture fully closed on all sides by the embed plate, the aperture having with a shape defined by first cross sections of at least a longer and a shorter dimension and at least one anchor extending from the embed plate;

a support member having a rear surface configured to be connected to the embed plate; the support member comprising:

a locking plate having a shape complementary to the aperture shape with second cross sections of at least a longer and a shorter dimension and sized to fit in the aperture;

a shaft having a proximal end connected to the rear surface of the support member and a distal end, spaced from the proximal end connected to the locking plate;

wherein when the locking plate is positioned adjacent the embed plate, the locking plate can be inserted into the aperture of the embed plate and rotated to a position where a longer cross section of the locking plate overlaps the shorter cross section of the aperture so the longer cross section of the locking plate abuts the embed plate.

2. The bracket assembly of claim 1 wherein the aperture is a rectangular shape.

3. The bracket assembly of claim 2 wherein the locking plate is a rectangular shape.

4. The bracket assembly of claim 1 further comprising a recess plate surrounding at least a portion of the aperture.

5. The bracket assembly of claim 4 further comprising a cover plate overlaying at least a portion of the recess plate.

6. The bracket assembly of claim 4 wherein the recess plate is substantially U shaped.

7. The bracket assembly of claim 1 wherein the at least one anchors extends orthogonal from the embed plate.

8. The bracket assembly of claim 1 wherein the at least one anchor includes five anchors.

9. The bracket assembly of claim 1 wherein the shaft is egg or ellipse shaped.

10. The bracket assembly of claim 1 further comprising locking pins extending from the locking plate.

11. The bracket assembly of claim 1 wherein the support member comprises one of a saddle or a gusset.

12. The bracket assembly of claim 1 further comprising a wave groove located along at least a portion of a bottom surface of the aperture.

13. The bracket assembly of claim 12 wherein the wave groove on the aperture is configured to engage the wave groove on shaft to maintain the position of the shaft relative to the aperture.

14. A bracket assembly for mounting in a cast structure, comprising:

an embed plate having an aperture with a shape defined by first cross sections of at least a longer and a shorter dimension and at least one anchor extending from the embed plate;

a support member having a rear surface configured to be connected to the embed plate; the support member comprising:

a locking plate having a shape complementary to the aperture shape with second cross sections of at least a longer and a shorter dimension and sized to fit in the aperture;

an egg or ellipse shaped shaft having a proximal end connected to the rear surface of the support member and a distal end, spaced from the proximal end connected to the locking plate;

wherein when the locking plate is positioned adjacent the embed plate, the locking plate can be inserted into the aperture of the embed plate and rotated to a position where a longer cross section of the locking plate overlaps the shorter cross section of the aperture so the longer cross section of the locking plate abuts the embed plate.

15. The bracket assembly of claim 14 further comprising a wave groove located along at least a portion of a bottom surface of the aperture.

16. The bracket assembly of claim wherein the wave groove on the aperture is configured to engage the wave groove on shaft to maintain the position of the shaft relative to the aperture.

17. A bracket assembly for mounting in a cast structure, comprising:

an embed plate having an aperture with a shape defined by first cross sections of at least a longer and a shorter dimension and at least one anchor extending from the embed plate;

a wave groove located along at least a portion of a bottom surface of the aperture;

a support member having a rear surface configured to be connected to the embed plate; the support member comprising:

a locking plate having a shape complementary to the aperture shape with second cross sections of at least a longer and a shorter dimension and sized to fit in the aperture;

a shaft having a proximal end connected to the rear surface of the support member and a distal end, spaced from the proximal end connected to the locking plate;

wherein when the locking plate is positioned adjacent the embed plate, the locking plate can be inserted into the aperture of the embed plate and rotated to a position where a longer cross section of the locking plate overlaps the shorter cross section of the aperture so the longer cross section of the locking plate abuts the embed plate.

18. The bracket assembly of claim 17 wherein the shaft is egg or ellipse shaped.

19. The bracket assembly of claim 17 wherein the wave groove on the aperture is configured to engage the wave groove on shaft to maintain the position of the shaft relative to the aperture.

* * * * *